US009227753B2

(12) United States Patent
Saulas

(10) Patent No.: US 9,227,753 B2
(45) Date of Patent: Jan. 5, 2016

(54) FASTENING MECHANISM FOR A CARTON

(71) Applicant: MeadWestvaco Packaging Systems, LLC, Richmond, VA (US)

(72) Inventor: Alain Saulas, Chateauroux (FR)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/352,132

(22) PCT Filed: Oct. 18, 2012

(86) PCT No.: PCT/US2012/060815

§ 371 (c)(1),
(2) Date: Apr. 16, 2014

(87) PCT Pub. No.: WO2013/059462

PCT Pub. Date: Apr. 25, 2013

(65) Prior Publication Data

US 2014/0346220 A1 Nov. 27, 2014

(30) Foreign Application Priority Data

Oct. 17, 2011 (GB) ..... 1117893.6

(51) Int. Cl.
*B65D 5/66* (2006.01)
*B65D 71/12* (2006.01)

(52) U.S. Cl.
CPC ..... *B65D 5/6608* (2013.01); *B65D 71/12* (2013.01); *B65D 2571/0016* (2013.01)

(58) Field of Classification Search
USPC ..... 229/128, 158; 493/137
See application file for complete search history.

(56) References Cited

U.S. PATENT DOCUMENTS 4,878,612 A * 11/1989 Schuster ..... 206/485.1
5,868,308 A * 2/1999 Briand ..... 229/198.2

FOREIGN PATENT DOCUMENTS

| | | |
|---|---|---|
| CA | 1243004 | 10/1988 |
| CN | 1922081 | 2/2007 |
| EP | 371298 | 6/1990 |
| EP | 785895 | 7/1997 |
| WO | WO 2006/083941 | 8/2006 |

OTHER PUBLICATIONS

Translation of Search Report from Chinese Patent Application No. 201280050978.8 dated Jan. 21, 2015.

* cited by examiner

*Primary Examiner* — Christopher Demeree
(74) *Attorney, Agent, or Firm* — WestRock Intellectual Property Group

(57) ABSTRACT

A locking device for a carton comprising a first part and a second part complementary to the first part, the first part comprising a first panel (12) having an aperture for receiving the second part, the second part comprising a tab (22) coupled to a second panel, the tab having a fold line (15*a*, 15*b*) foldable to form a leading edge, the tab being inserted into the aperture in a folded condition, the tab comprising at least one engaging edge (30*a*, 30*b*) for engaging with the first panel.

14 Claims, 7 Drawing Sheets

FASTENING MECHANISM FOR A CARTON

CROSS-REFERENCE TO RELATED APPLICATIONS

This application is a National Phase application of PCT Application PCT/US12/060815 filed Oct. 18, 2012, which claims the benefit of GB Application No. 1117893.6, filed Oct. 17, 2011, which is incorporated herein by reference in its entirety.

FIELD OF THE INVENTION

The present invention relates to a fastening mechanism for a carton and a blank for forming the same; more specifically, but not exclusively, to a fastening mechanism comprising a male component having a foldable tab for locking two panels of a carton together.

BACKGROUND OF THE INVENTION

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable in such packages to provide a fastening device for locking two panels of a carton together. In use, fastening devices known in the art can be inadvertently disengaged. It is therefore desirable to provide a fastening means which is robust and remains in a locked condition, but which may be unlocked if required.

SUMMARY OF INVENTION

The present invention seek to overcome or at least mitigate the problems of the prior art.

According to a first aspect of the present invention there is provided a locking device for a carton comprising a first part and a second part complementary to the first part, the first part comprising a first panel having an aperture for receiving the second part, the second part comprising a tab coupled to a second panel, the tab being hinged to the second panel by a fold line about which the tab is folded to form a leading edge, the tab being inserted into the aperture in a folded condition, the tab comprising at least one engaging edge for engaging with the first panel whereby locking the first and second panels together.

Preferably, the engaging edge of the tab engages the first panel when the tab is in a folded condition.

Preferably, the fold line is interrupted by a cutline at least a portion of which is offset with respect to the fold line so as to define a first protrusion for preventing the tab from unfolding, the first protrusion being struck from either the tab or the second panel. Optionally, the cutline may be arcuate in shape.

Preferably, the tab comprises a tongue and the aperture comprises a recess, the recess being arranged to receive at least a portion of the tongue therein thereby preventing the tab from unfolding.

Preferably, the tab in the folded condition is tapered so as to be narrower at a leading edge thereof.

Preferably, the first panel comprises a flap defined in part by a second fold line and a cut line, the cutline defining at least in part the aperture when the flap is folded about the second fold line. More preferably the cut line and the second fold line are contiguous.

Preferably, the cutline defines, at least in part, a second protrusion which overlaps at least partially with the second panel in a locked condition.

Preferably, the tab is hinged to a projection forming part of the second panel. More preferably the projection is struck from the second panel and at least one recess is struck from the second panel and is disposed adjacent the projection such that the second panel overlaps with the first panel in a locked condition.

According to a second aspect of the present invention there is provided a carton comprising the locking device herebefore described.

According to a third aspect of the present invention there is provided a blank for forming a carton, the blank comprising a first panel and a second panel, the first panel comprising a first part of a complementary locking mechanism the second panel comprising a second part of a complementary locking mechanism, the first part comprising a cutline or weakened line of severance defining at least in part an aperture for receiving the second part, the second part comprising a tab coupled to the second panel, the tab being hinged to the second panel by a fold line about which the tab is foldable to form a leading edge, the tab comprising at least one engaging edge for engaging with the first panel such that the first and second panels may be locked together.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1B:
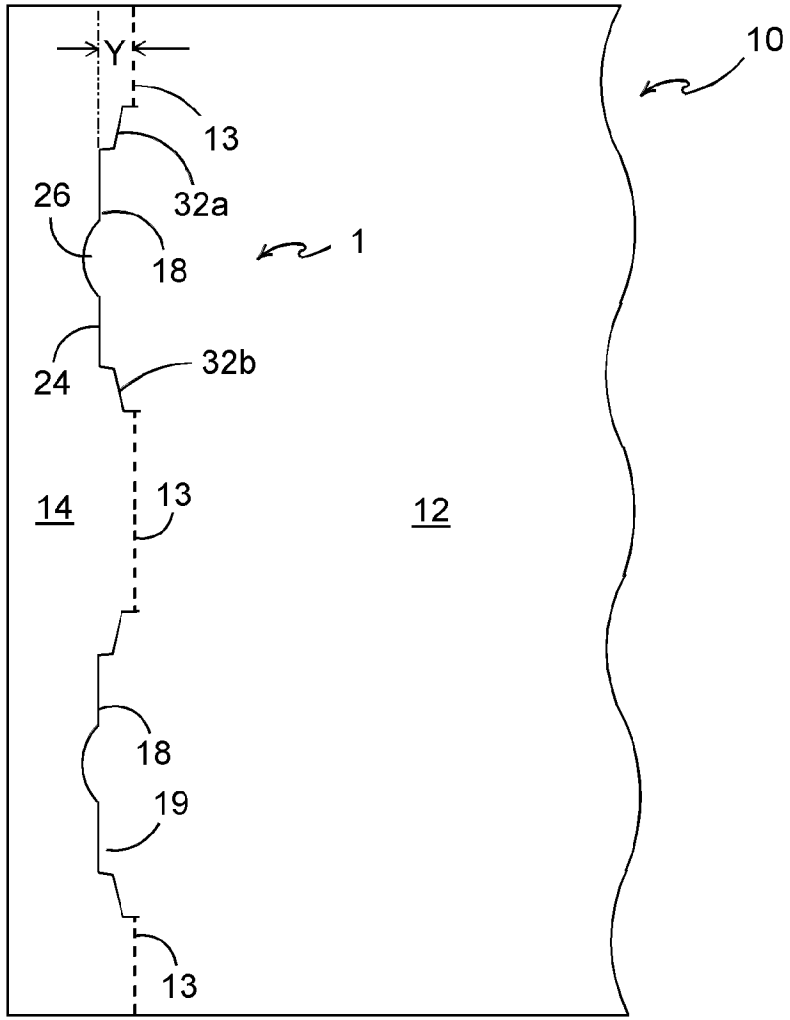
FIGS. 1A AND 1B are plan views from above of portions of a blank comprising a fastening device according to an embodiment of the invention.
Figure 1A:
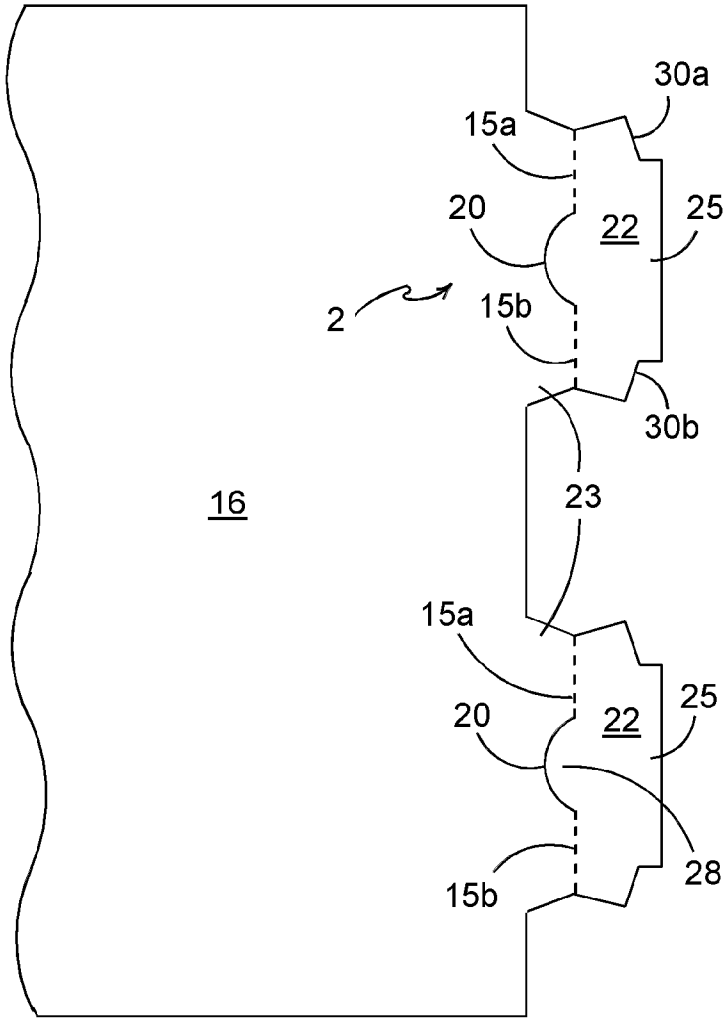

Referring to FIGS. 1A and 1B, there are shown plan views of portions of a blank 10 capable of forming a carton for primary products such as, but not limited to, bottles or cans, hereinafter referred to as articles.

The blank 10 comprises a fastening device for locking first panel 12 and second panel 16 of the blank 10 together. It is envisaged that the first and second panel 12, 16 may be integrally formed in a single unitary blank or may be provided by separate blanks.

Blank 10 comprises two complementary locking devices. Blank 10 comprises a first part 1 of a complementary locking device and a second part 2 of a complementary locking device.

First part 1 comprises a flap 14 hingedly connected to first panel 12 by fold line 13.

Fold line 13 is interrupted by a cut line or weakened line of severance 24. Cutline 24 is at least partially offset from fold line 13. In the illustrated embodiment the cut line 24 is disposed or located within flap 14, such that it defines in part a first projection 19, which first projection 19 is integrally formed with the first panel 12.

Cutline 24 is stepped or tiered in shape; a central arcuate portion defines a leading edge of first projection 19. A first linear section is disposed on either side of the central arcuate portion. First linear section defines a first tier. A second tier is disposed on either side of the first tier. Second tier is defined by outer portions 32*a*, 32*b* of cutline 24 and is disposed closer to fold line 13 than the first tier. The outer portions 32*a*, 32*b* defining the second tier are preferably disposed at an angle with respect to the fold line 13 and with respect to the first tier; the outer edges of the outer portions 32*a*, 32*b* of cutline 24 defining the second tier being disposed closer to the fold line 13 than the inner edges of the outer portions 32*a* , 32*b*.

The portion of the cut line 24 defining the first tier and the central arcuate portion define a recess 18 in flap 14 in a folded condition, which recess 18 is arranged to receive a portion of the second part of the complementary locking mechanism.

The arcuate portion of cutline 24 defines a tab 26 which extends from the first projection 19.

The second part 2 comprises a foldable tab 22 hingedly connected to a second projection 23 along a fold line 15*a*, 15*b*. Second projection 23 extends from a free edge of second panel 16. The fold line 15*a*, 15*b* is interrupted by a cut line or weakened line of severance 20; cut line 20 is arcuate in shape and forms a tab 28 which is struck from material forming the second projection 23. The tab 28 is integral with the foldable tab 22. A free end edge of the tab 22 opposing the fold line 15*a*, 15*b* is stepped or tiered in shape; an outermost tier defines in part a tongue 25 disposed centrally within the tab 22. Tongue 25 is sized and arranged to be received in recess 18.

Outer portions define in part the second tier of the tab 22, each outer portion having an engaging edge 30*a*, 30*b* respectively; the second tier is disposed in closer proximity to the fold line 15*a*, 15*b* than the first tier.

The second tier forms shoulders on either side of the central tongue 25.

Turning to the assembly of the fastening device as illustrated in FIGS. 2 to 6, it is envisaged that the fastening device can be formed by a series of sequential folding operations in a straight line machine so that the carton is not required to be rotated or inverted to complete its construction. The folding process is not limited to that described below and may be altered according to particular manufacturing requirements.

Figure 3:
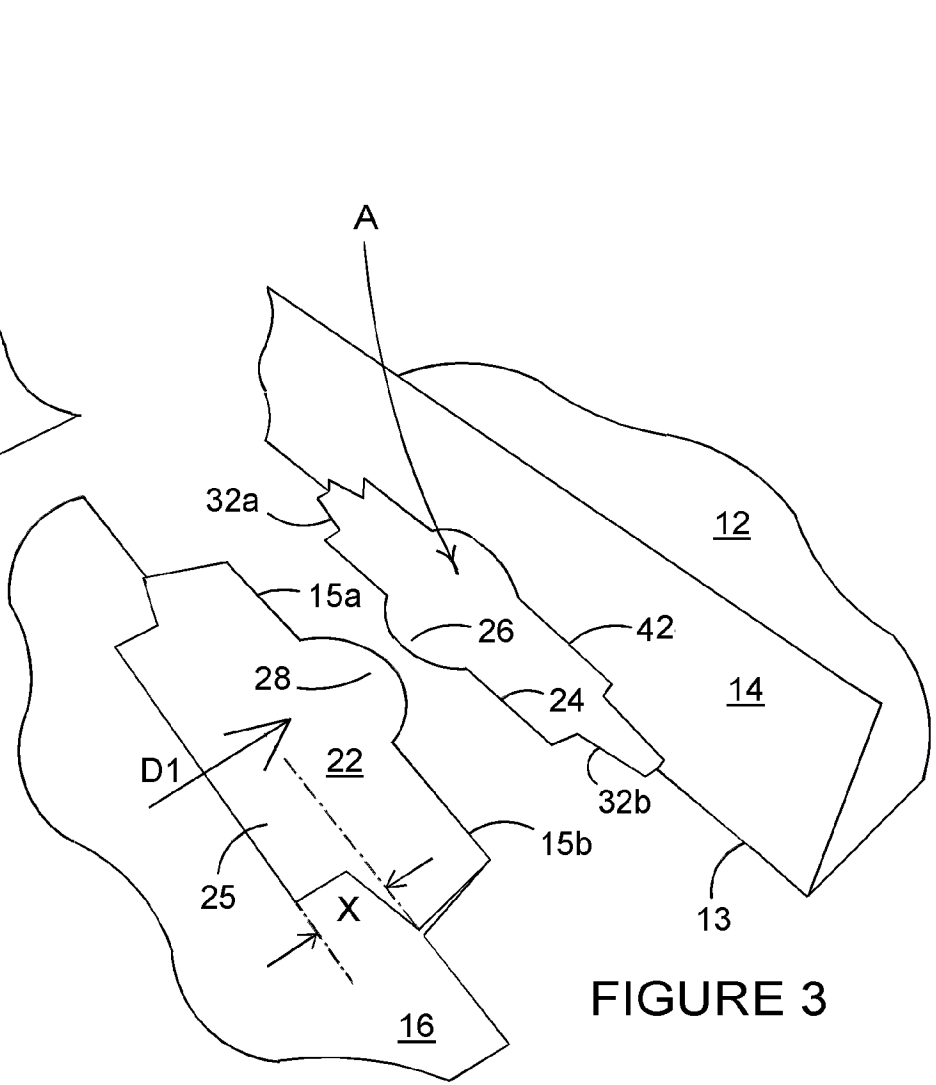
FIG. 3 is a perspective view from above of a further assembly stage of the fastening device of FIGS. 1A and 1B.
Figure 2:
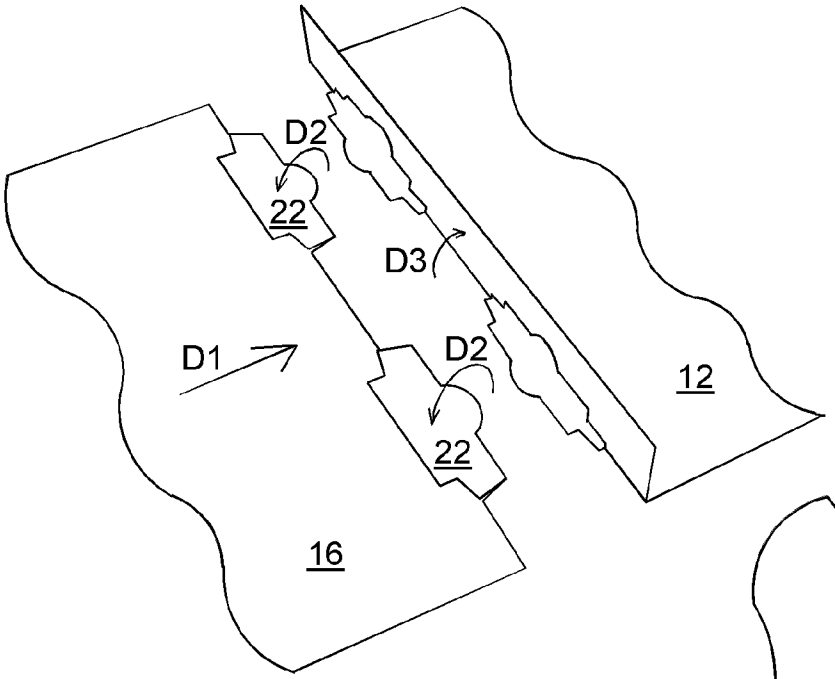
FIG. 2 is a perspective view from above of an assembly stage of the fastening device of FIGS. 1A and 1B.

FIGS. 2 and 3 illustrate a stage of assembly of the fastening device. The flap 14 has been folded about fold line 13 as indicated by directional arrow D3. Preferably, the flap 14 is folded to be perpendicular to first panel 12; more preferably, the flap 14 is folded so as to define an acute angle between the flap 14 and first panel 12. In other words, the flap 14 is folded out of a plane containing the first panel 12 by an angle greater than 90 degrees. In folding the flap 14, an aperture A has been created between the flap 14 and the first panel 12.

Tab 22 is folded about fold line 15*a*, 15*b* as indicated by directional arrow D2, into substantially overlapping or overlying relationship with second projection 23 and at least a portion of second panel 16.

Figure 4:
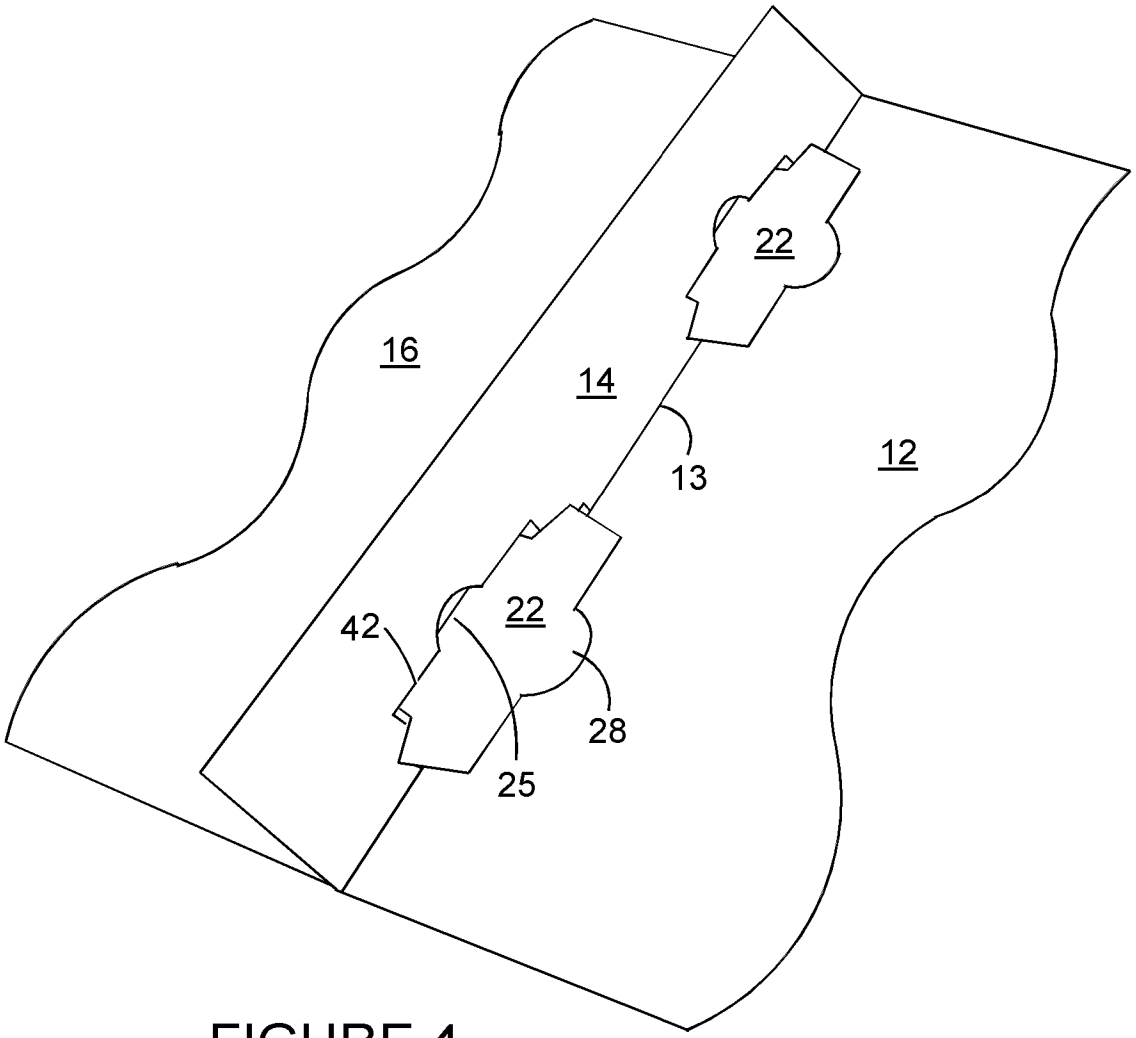
FIG. 4 is a perspective view from above of an assembled fastening device of FIG. 1A and FIG. 1B in a locked condition.
Figure 5:
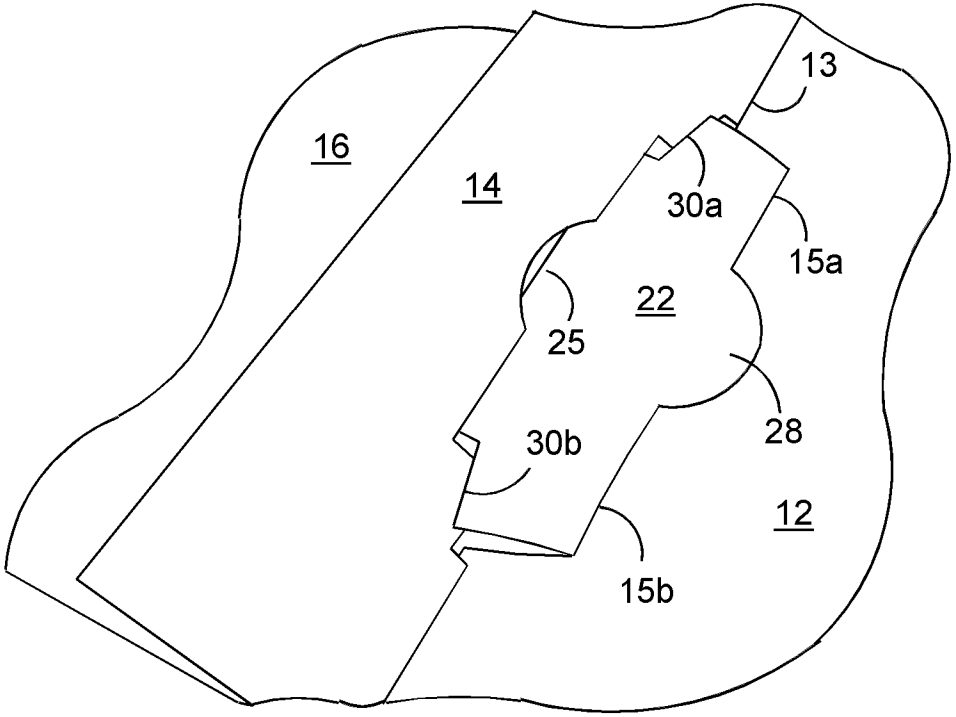
FIG. 5 is an enlarged perspective view from above of a portion of the fastening device of FIG. 5.

The first and second panels 12, 16 are moved with respect to one another as indicated by directional arrow D1 so as to insert the folded tab 22 into aperture A. As illustrated in FIGS. 4 and 5 the tab 22, in a folded condition, at least partially passes through the aperture A. The tab 22 engages with the aperture A created by folding the flap 14. The tongue 25 engages with an upper edge 42 of the aperture A; upper edge 42 defines at least in part the recess 18 in which the tongue 25 is received. In the way the upper edge 42 restricts the tab 22 from unfolding. The engaging edges 30*a*, 30*b* of the outer portions of tab 22 engage with the flap 14 at locations disposed adjacent to the recess 18.

In the illustrated embodiment of FIGS. 4 and 5, the flap 14 has unfolded, at least partially, about fold line 13, so as to define an obtuse angle between the flap 14 and the first panel 12. Similarly, the tab 22 has partially unfolded about fold line 15*a*, 15*b*.

Tongue 25 of tab 22 is received in recess 18.

Preferably, in the folded state, the tab 22 overlaps with the second panel 16 by a distance X, as illustrated in FIG. 3; a second distance Y is defined between the fold line B and cutline 18 as illustrated in FIG. 1B, the distance X is greater than second distance Y such that tab 22 cannot pass entirely through the aperture A even when the flap 14 is coplanar with the first panel 12.

Shoulder portions 30*a*, 30*b* engage with those portions of flap 14 disposed on either side of recess 18 and defined in part by cut lines 32*a*, 32*b*.

Upward travel, unfolding, of the tab 22 is limited by the flap 14. The tongue 25 engages with the edge of recess 18.

Tab 28 engages with first panel 12 limiting unfolding of foldable tab 22.

It will also be appreciated that tab 22 in the folded condition is tapered so that it is narrower in width towards the leading edge. This assists in aligning the tab 22 with the aperture A, since the leading edge is smaller in dimension than the aperture A.

It will also be understood that if the tab 22 is inserted entirely through aperture A inadvertently, then the first and second panels 12,16 remain locked together since the tab 22 cannot unfold into a flat condition by virtue of the arcuate tab 28, which engages first panel 12 preventing unfolding.

Figure 6:
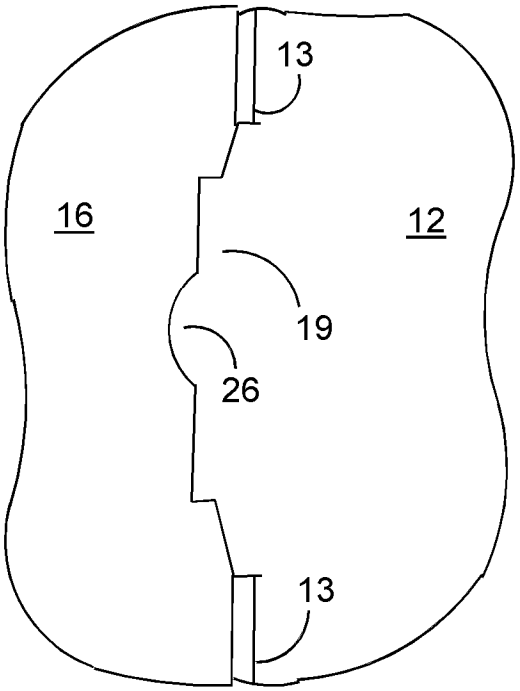
FIG. 6 is a plan view from below of the fastening device of FIG. 5.

FIG. 6 illustrates the first and second panels 12, 16 in a locked condition. The tab 26 and projection 19 at least partially overlap with second panel 16; the tab 26 and projection 19 being disposed outermost. This overlapping relationship is optional, but when provided increases security by preventing or reducing folding of first panel 12 about fold line 13, thereby helping to maintain first and second panels 12, 16 in a substantially co-planar, or at least substantially parallel, relationship with one another.

Referring now to FIGS. 7*a*, 7*b* and 8 to 10, there is shown an alternative embodiment of the present invention. In the alternative illustrated embodiment, like numerals have, where possible, been used to denote like parts, albeit with the addition of the prefix "100" and so on to indicate that these features belong to the alternative embodiment. The alternative embodiment shares many common features with the first embodiment and therefore only the differences from the embodiment illustrated in FIGS. 1 to 6 will be described in any greater detail.

Figure 7B:
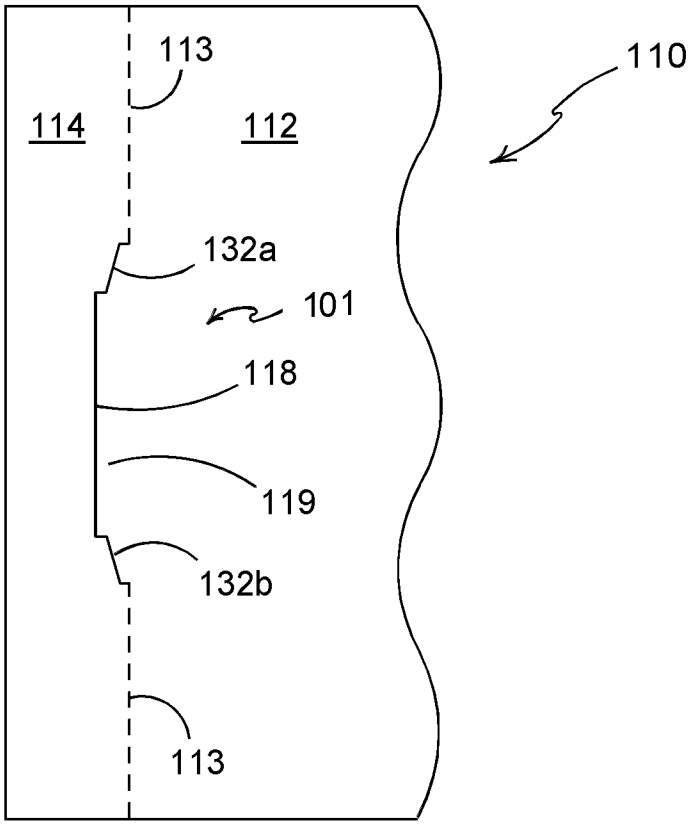
FIGS. 7A and 7B are plan views from above of portions of a blank comprising a fastening device according to a second embodiment of the invention.
Figure 7A:
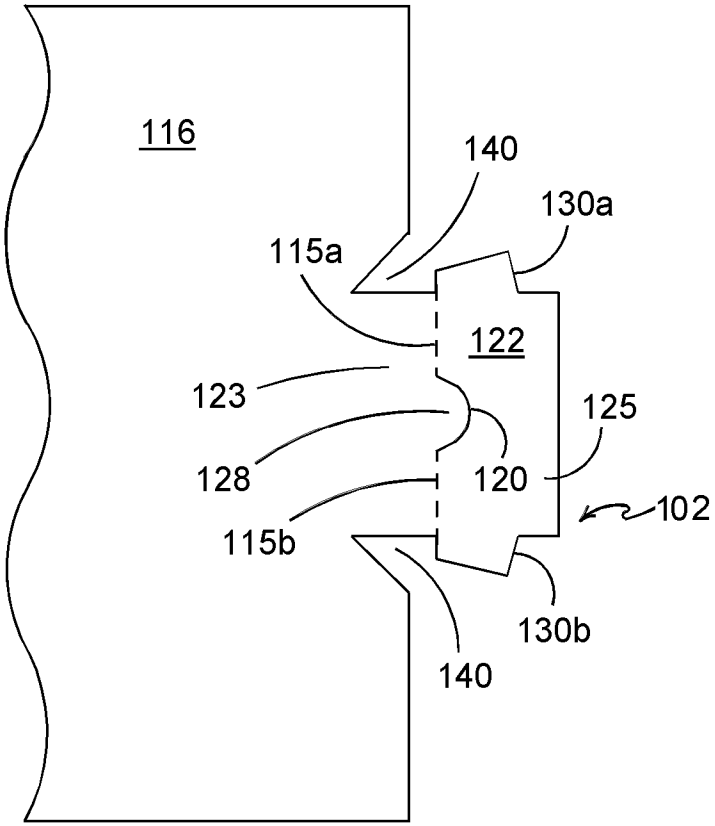

FIGS. 7A and 7B illustrate a blank of an alternative embodiment of the invention.

The first part 101 of the complementary fastening device differs in that the central portion of cutline 118 is not arcuate, but is co-linear with the outer portions thereof. Tab 119 does not therefore comprise an arcuate shaped tab extending outwardly from a central portion therefrom.

Figure 10:
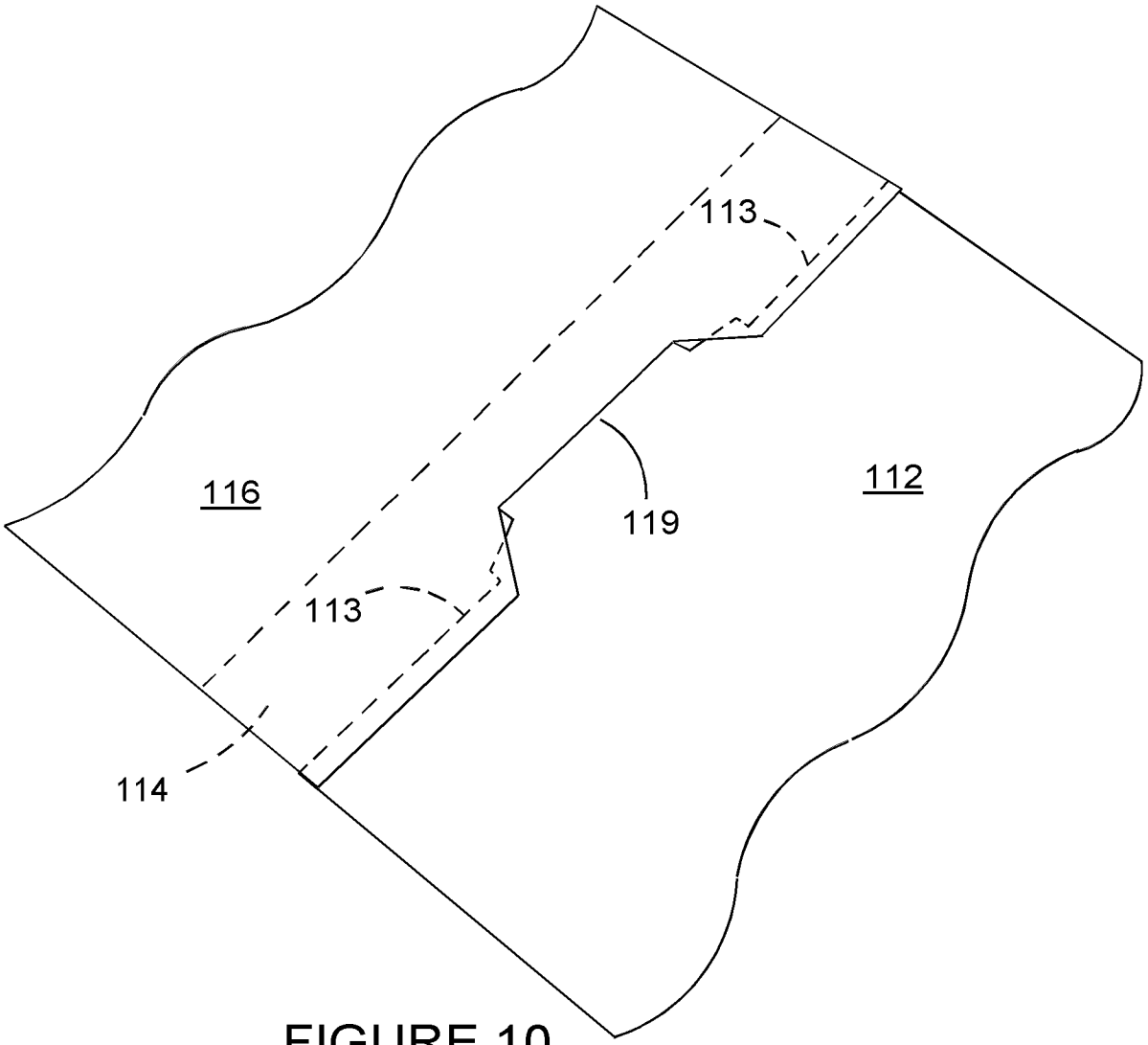
FIG. 10 is a plan view from below of the fastening device of FIG. 9.

The second part 102 of the complementary fastening device has been modified such that in a set up condition portions of second panel 116 overlap with first panel 112, second panel 116 being disposed outermost, as shown in FIG. 10.

The projection 123 is disposed between a pair of recesses 140 disposed on opposing sides thereof such that the second panel 116 extends towards the tab 122 beyond the connection between projection 123 and second panel 116.

Tab 122 is hinged to projection 123 by fold lines 115*a*, 115*b*. Tab 122 is wider than projection 123 at least at the point at which it is hinged to the projection 123 by the fold line 115*a*, 115*b*.

Tongue 125 is substantially the same width as projection 123. Outer portions of tab 122 are tapered so as to get wider as they extend to shoulder portions 130*a*, 130*b*.

Cutline 120 is arcuate in shape and defines at least in part a tab 128; tab 128 in this embodiment is struck from material forming the tab 122 whereas previously it had been struck from the projection 23.

Figure 8:
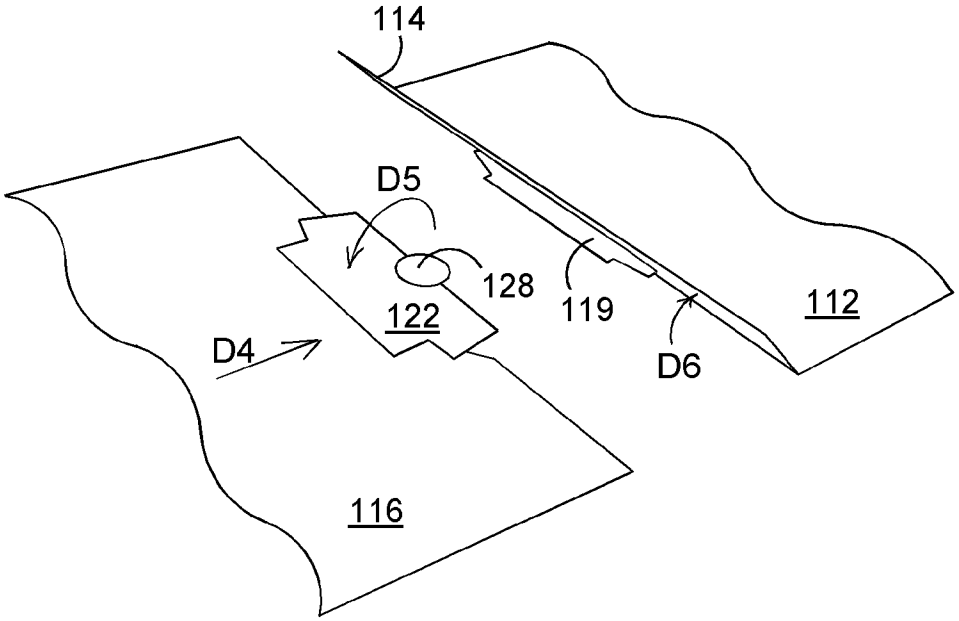
FIG. 8 is a perspective view from above of a stage of assembly of the fastening device of FIGS. 7A and 7B.
Figure 9:
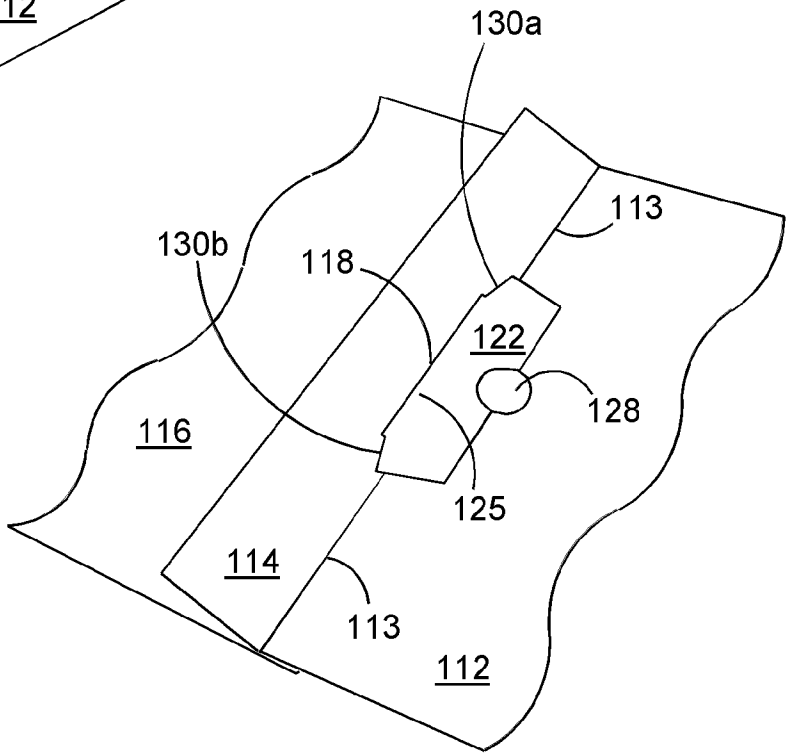
FIG. 9 is a perspective view from above of a fastening device of FIGS. 1A and 1B in an engaged condition.

Assembly of the fastening device is substantially similar to that of the previous embodiment; however the flap 114 is folded out of the plane of the first panel 112 by an angle less than 90 degrees, as indicated by directional arrow D6 and illustrated in FIGS. 8 and 9.

Tab 122 is folded into overlapping relationship with projection 123, as indicated by directional arrow D5. The first and second panels 112, 116 are moved together with respect to one another, as indicated by directional arrow D4, and tab 122 is at least partially inserted into an aperture defined in part by cutline 118, accessed by folding tab 114 with respect to first panel 112.

It can be appreciated that various changes may be made within the scope of the present invention, for example, the size and shape of the panels and apertures may be adjusted to accommodate articles of differing size or shape. For example each part of the locking device may be provided in a single unitary blank or may be provided in separate blanks.

It will be recognised that as used herein, directional references such as "top", "bottom", "front", "back", "end", "side", "inner", "outer", "upper" and "lower" do not limit the respective panels to such orientation, but merely serve to distinguish these features from one another. Any reference to hinged connection should not be construed as necessarily referring to a single fold line only; indeed it is envisaged that hinged connection can be formed from one or more of the following, a short slit, a frangible line or a fold line without departing from the scope of the invention.

The invention claimed is:

1. A locking device for locking first and second panels together, the locking device comprising a first part and a second part, the first part comprising an edge flap hingedly connected to the first panel along a first fold line and an aperture defined at least in the edge flap by a cutline which is tiered in shape, the cutline including a first cutline section and a pair of second cutline sections, the first cutline section defining a recess portion of the aperture, the second cutline sections being disposed on opposite sides of the recess portion and defining engaging portions of the edge flap, the second cutline sections being disposed closer to the first fold line than the first cutline section, the second part comprising a projection extending to a second fold line from a free edge of the second panel and a foldable tab hingedly connected to the projection along the second fold line, the foldable tab having a free end edge opposing the second fold line, the free end edge being stepped in shape and including a first step portion and a pair of second step portions, the first step portion defining a tongue of the foldable tab, the second step portions being disposed on opposite sides of the tongue and defining shoulders of the foldable tab, the second step portions being disposed closer to the second fold line than the first step portion, the foldable tab being folded about the second fold line to take a folded position, the second part being received in the aperture with the foldable tab in the folded position, the second part assumes a locking position when in the aperture in which the tongue of the foldable tab is received at least in part in the recess portion of the aperture to cause the shoulders of the foldable tab to engage with the engaging portions of the edge flap.

2. The locking device according to claim 1, wherein the first fold line is interrupted by the cutline, the first cutline section of the cutline is offset with respect to the first fold line so as to prevent the foldable tab from unfolding, the first cutline section being provided by the edge flap.

3. The locking device according to claim 1, wherein the second part, when the foldable tab is in the folded position, is tapered so as to be narrower at the leading edge thereof.

4. The locking device according to claim 1, wherein the cutline defines, at least in part, a protrusion which overlaps at least partially with the second panel when the second part is in the locked position.

5. The locking device according to claim 4, wherein the protrusion is struck from the edge flap such that the recess portion is defined in the edge flap.

6. The locking device according to claim 1, wherein the shoulders comprise engaging edges spaced apart from the second fold line.

7. The locking device according to claim 1, wherein the projection of the second part is received at least in part in the aperture when the second part is in the locking position.

8. The locking device according to claim 1, wherein the second cutline section defining the second tier portion is disposed at an angle with respect to the first fold line such that one end of the second cutline section that is spaced apart from the first cutline section is disposed closer to the first fold line than the other end of the second cutline section that is next to the first cutline section.

9. The locking device according to claim 1, wherein the second fold line defines a leading edge of the second part when the foldable tab is in the folded position, and wherein the second part is received with the leading edge first in the aperture.

10. The locking device according to claim 1, wherein in the folded position, the foldable tab overlaps with the second panel such that a first distance is defined between the free edge of the second panel and the first step portion of the free end edge of the foldable tab, wherein a second distance is defined between the first fold line and the first cutline section of the cutline, and wherein the first distance is greater than second distance such that foldable tab cannot pass entirely through the aperture when the second part is in the locking position.

11. A carton comprising a first panel, second panel and a locking device for locking the first and second panels together, the locking device comprising a first part and a second part, the first part comprising an edge flap hingedly connected to the first panel along a first fold line and an aperture defined at least in the edge flap by a cutline which is tiered in shape, the cutline including a first cutline section and a pair of second cutline sections, the first cutline section defining a recess portion of the aperture, the second cutline sections being disposed on opposite sides of the recess portion and defining engaging portions of the edge flap, the second cutline sections being disposed closer to the first fold line than the first cutline section, the second part comprising a projection extending to a second fold line from a free edge of the second panel and a foldable tab hingedly connected to the projection along the second fold line, the foldable tab having a free end edge opposing the second fold line, the free end edge being stepped in shape and including a first step portion and a pair of second step portions, the first step portion defining a tongue of the foldable tab, the second step portions being disposed on opposite sides of the tongue and defining shoulders of the foldable tab, the second step portions being disposed closer to the second fold line than the first step portion, the foldable tab being folded about the second fold line to take a folded position, the second part being received in the aperture with the foldable tab in the folded position, the second part assumes a locking position when in the aperture in which the tongue of the foldable tab is received at least in part in the recess portion of the aperture to cause the shoulders of the foldable tab to engage with the engaging portions of the edge flap.

12. The carton according to claim 11, wherein the shoulders comprise engaging edges spaced apart from the second fold line.

13. The carton according to claim 11, wherein the projection of the second part is received at least in part in the aperture when the second part is in the locking position.

14. The carton according to claim 11, wherein in the folded position, the foldable tab overlaps with the second panel such that a first distance is defined between the free edge of the second panel and the first step portion of the free end edge of the foldable tab, wherein a second distance is defined between the first fold line and the first cutline section of the cutline, and wherein the first distance is greater than second distance such that foldable tab cannot pass entirely through the aperture even when the second part is in the locking position.

* * * * *